United States Patent [19]

Rathbun

[11] 3,931,686

[45] Jan. 13, 1976

[54] ELASTIC LACE AND HOOK FASTENER

[76] Inventor: Archie B. Rathbun, P.O. Box 237, Sommers, Mont. 59932

[22] Filed: Feb. 25, 1974

[21] Appl. No.: 445,779

[52] U.S. Cl. ..... 36/51
[51] Int. Cl.[2] ..... A43B 11/00
[58] Field of Search ..... 24/73 ES, 73 GC, 143 A, 24/267; 36/50, 51

[56] References Cited

UNITED STATES PATENTS

| | | | |
|---|---|---|---|
| 918,571 | 4/1909 | Mauersberger | 24/73 ES |
| 3,193,950 | 7/1965 | Liou | 36/50 |

FOREIGN PATENTS OR APPLICATIONS

| | | | |
|---|---|---|---|
| 431,215 | 2/1948 | Italy | 36/50 |
| 716,287 | 12/1941 | Germany | 36/50 |

*Primary Examiner*—Geo. V. Larkin

[57] ABSTRACT

A fastener for closure in wearing apparel having adjacent edges with spaced opposed eyelets providing two elongate elastic elements each laced through eyes along one edge of the closure to form adjacent spaced loops with plural hook elements releasably joining opposed loops on each side of the closure. The fastener is particularly adapted for use in boots.

3 Claims, 6 Drawing Figures

ELASTIC LACE AND HOOK FASTENER

BACKGROUND OF INVENTION

RELATED APPLICATIONS

There are no applications related hereto now filed in this or any foreign country.

FIELD OF INVENTION

This invention relates generally to fasteners for lace type closures and particularly opposed elastic laces releasably joined by plural hooks.

DESCRIPTION OF THE PRIOR ART

The common non-elastic fabric lace associated with plural opposed eyelets to releasably fasten together separated parts of wearing apparel to form closures, particularly in footwear and leggings, has inadequacies notwithstanding the extensive use of this method of closures. The closure lacks some movability and conformability primarily because of its non-elastic nature and is difficult of establishment when cross laced in the ordinary fashion. In the past other improved lace-type methods of eyed closures to accomplish such fastening with differing benefits in particular cases have become known. The instant invention is one of this class.

Obviously, however, if such improved methods are to be at all useful in existing garments they must be compatible in their fastening with the present eyelet structure of the wearing apparel in which they are to be used. Heretofore such improved lace-type fastening methods have evolved along two essential lines; firstly that involving a continuous lace of the normal non-elastic configuration, composed of or containing an elastic element, that is positioned in some fashion between eyelets on both sides of the laced closure, and secondly, a plurality of elastacized members, each associated in some releasable fashion with only the two members of a pair of opposed eyelets, and having no association with other eyelets outside that pair. Each of these systems possesses individual advantages and disadvantages. In the first instance the lacing gives elasticity at any point along the length of the closure as required by strain upon the area at a particular time and also allows for lineal lace adjustment, but there is the inconvenience in establishment, as the lace must be long and individually threaded and adjusted through the several eyelets on each side of the closure. In the second instance there is not the contributory adjustable conformity to varying stress throughout the length of the closure, as the particular elastic functions are limited to one particular pair of opposed eyelets and their associated fasteners; however, the ease and simplicity of fastening is greater because there is no necessity of using a long lace and having to adjust it or lace it by its end or ends through the several eyelets involved. With these factors and this background in mind, the instant invention seeks to provide new and unique lacing that has the advantages of each of the improved types mentioned but is without the disadvantages of either.

SUMMARY OF INVENTION

My invention provides generally paired cooperating elastic laces each associated with plural spaced eyelets on each side of a garment closure to form opposed cooperating loops that are releasably joined by plural rigid hook elements. Preferably the laces are laced alternately through adjacent eyelets and the hook elements are permanently carried on one lace and releasably attachable to the other.

In providing such a closure fastening system it is:

A principal object of my invention to provide an elastic fastening means, for use upon eyelet-type lace-closing structures having paired opposed eyelets adjacent the opposed abutting parts of such laceable closure, that may be rapidly fastened or unfastened after establishment without passing the end of a lace through the various eyelets.

A further object of my invention to provide a fastening means of the nature aforesaid that is contributorily elastically adjustable throughout its length to provide for variations in movement of the proposed members of the laced structure in response to conformal stress thereon.

A further object of my invention to provide a fastening means of the nature aforesaid that is compatible with and may be used upon existing eyelet-type lace closing structures of wearing apparel without modification thereof and may be releasably established therein with minimum effort.

A still further object of my invention to provide a fastener means of the nature aforesaid that is of new and novel design, of simple and economic manufacture, of rugged and durable nature, and otherwise well adapted to the uses and purposes for which it is intended.

Other and further objects of my invention will appear from the following specification, drawings and claims which form a part of this application. It is to be remembered, however, that its accidental features are susceptible of change in design and structural arrangement with only one preferred and practical embodiment being illustrated as required.

BRIEF DESCRIPTION OF DRAWINGS

In the accompanying drawings which form a part of this specification and wherein like numbers of reference refer to similar parts throughout.

DESCRIPTION OF PREFERRED EMBODIMENT

Figure 1:
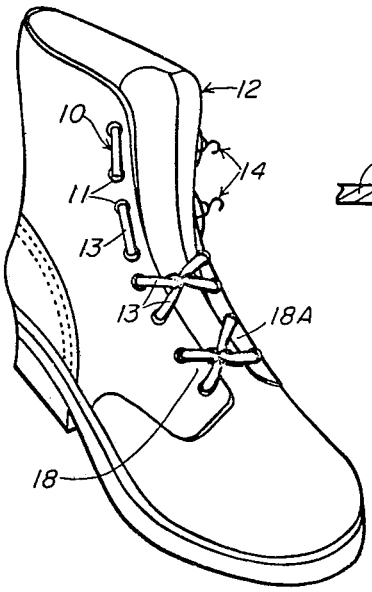
FIG. 1 is an isometric view of an ordinary high-top shoe of commerce, with my invention in place thereon, partially fastened and partially unfastened.
Figure 4:
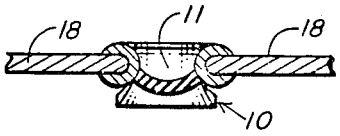
FIG. 4 is an orthographic cross-sectional view of FIG. 3 taken on the line 4—4 thereon in the direction indicated by the arrows.
Figure 5:
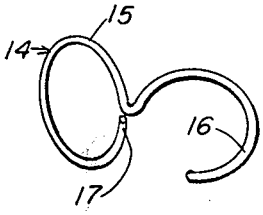
FIG. 5 is an enlarged isometric view of a particular type of a hooking device that I prefer to use with my invention.

Referring now to the drawings in more detail and particularly to that of FIG. 1, it will there be seen that my invention essentially comprises two elastic lace members 10, laced alternately through adjacent eyelets 11 of shoe 12 to form paired opposed loops 13, releaseably fastened together by hook fasteners 14.

My invention is particularly adapted to fasten the adjacent opposed lacing flies 18 of shoes 12 and leggings together, but it is to be understood in this regard that it is equally within the spirit of my invention to fasten laceable closures of garments and other articles of the same type having opposed spaced eyelets in the adjacent fastening parts. The invention is particularly extendable to articles of clothing and various containers, especially plastic or semi-rigid ones.

Lace 10 is an elongate strip of elastic, deformable material of appropriate surface constitution and preferably of substantially a rectangular cross-section as illustrated. I prefer to form this member from rubber, though other materials such as some plastics having like or similar physical properties would undoubtedly serve the purposes of my invention.

The size and physical characteristics of the lace are quite essential to the operation of my invention. The member must be such that loops 13 formed in it are sufficiently elastic and have sufficient physical strength to perform their function. The member must also be yieldably held in position within the eyelets 11 through which it passes, and this requires that the material be sufficiently elastically deformable, as illustrated, and of appropriate surface characteristics to create a frictional engagement between lace 10 and eyelet 11 so that the lace will not under normal circumstances readily pass therethrough but yet under unusual stresses will tend to yield slightly to somewhat equalize the stress throughout the laced closure or a substantial part of it.

To accomplish these purposes I have found rubber to be an ideal material. I prefer to have the cross-section of lace 10 of a width approximately one-fourth greater than the major internal diameter of eyelet 11, and of the thickness of approximately one-third of the internal diameter of the eyelet. The length of the member 10, obviously, will be dependent upon the size of the particular closing being fastened, but this length should be such that the lace may be positioned as hereinafter provided so that in normal unfastened condition it will have substantially no lineal stress within it.

Figure 3:
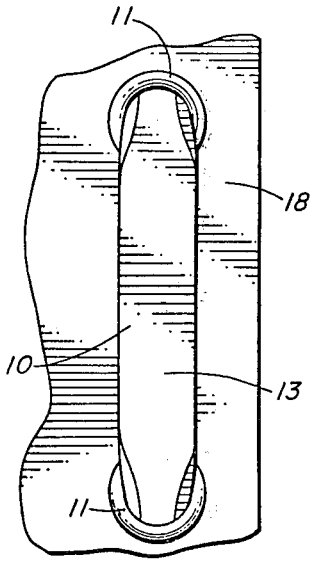
FIG. 3 is a partial enlarged orthographic view of my elastic lace passing through two adjacent eyelets, showing how the lace is frictionally and deformably engaged therewith.
Figure 6:
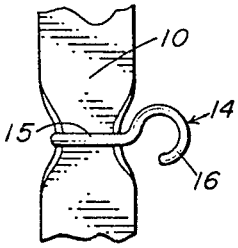
FIG. 6 is a somewhat enlarged partial orthographic view of the hooking device of FIG. 5 in place upon one of the elastic laces of my invention, showing the deformed frictional engagement between the two members.

With this sizing and dimensioning of the lace and with its particular physical characteristics, when an elongate stress is applied to the lace on one side of an eyelet as in FIG. 3, the elastic of the lace tends to elongate on that side, but if the pressure be less on that portion of the lace on the opposite side, the lace will tend to bind within the eyelet so that the function aforementioned is attained. This binding is caused by the deformed frictional engagement of the lace on the far side of the strained part contacting the surface of the eyelet on that side. This reaction is necessary to the proper functioning of my invention in the form illustrated in this disclosure.

Figure 2:
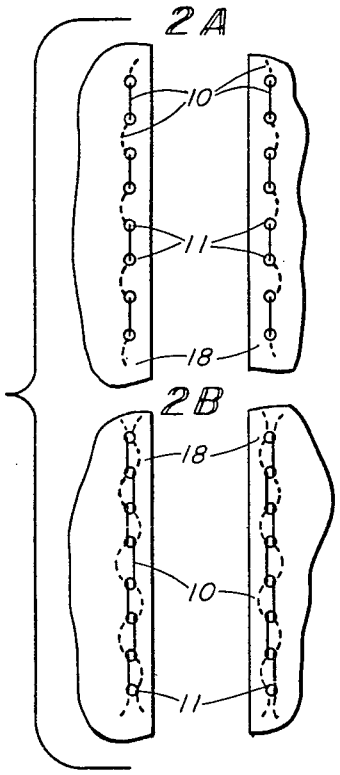
FIG. 2 is a diagrammatic representation illustrating a single method of establishing my elastic laces through ordinary eyelets of laceable closures in diagram 2A and a double method of establishment in diagram 2B.

It is necessary that elastic side laces 10 be positioned through the various eyelets on one side of fastening flap 18 so as to form loops 13 on the fastening side of the closure between eyelets where fastening is desired. This may be accomplished in at least two ways as illustrated in the diagrams of FIG. 2. In diagram 2A, if a single length of lace be threaded alternately through adjacent eyelets 11, firstly on one side of the fastening flap 18 and then the other, the result will be a series of loops 13 formed between each alternate pair of adjacent eyelets, as illustrated. If, however, loops 13 are desired between each adjacent pair of eyelets 11 of a fastening flap 18, lace 10 may be doubled and the two ends of lace 10 there threaded alternately through such eyelets 11, the two ends passing in opposite directions through each eyelet 11, as illustrated in diagram 2B. Either of these methods of positioning the elastic side laces may be used under the spirit of my invention, the particular choice depending upon particular desires of the user.

In either of the lacing methods illustrated in FIG. 2, an elastic lace 10 of the specified size and dimension is deformed in passing through an eyelet 11, and is frictionally engaged or bound therein. Each loop 13 (span of lace between eyelets) thus becomes substantially independent. The elastic property of lace 10 allows extension of loop 13 and provides an additional tightening or binding in the eyelet. The maximum yield of the loop 13 is at a point between eyelets 11; at eyelet 11, where lace 10 is bound, yield is minimal. Thus, there is no necessity to provide fastening at the lace ends (although end fastenings could be provided if desired), because the lace will not slip through the eyelet nearest the lace end because of the lace's frictional engagement or binding therein. The single provision of the extension of lace 10, approximately half the distance between adjacent eyelets 11, beyond the eyelet nearest the lace end is sufficient to insure the maintenance of the lace in the end eyelets.

The elastic laces 10 of my invention are preferably pointed at their ends, or carry some device such as a ferrule, as well known in the art, to aid in their insertion through the eyelets 11 upon establishment. The lace is normally established in place by manual minipulation or if desired a needle-like threading device (not shown) may be employed to assist in this operation.

To render my invention operable, paired opposed loops 13 in the elastic lacing member 10 must be releasably joined. One type of fastener 14 that accomplishes this purpose is illustrated in FIG. 3, but it is to be understood that there obviously are many other fastening devices that would serve this purpose and any that releaseably fastens two adjacent loops together would serve this purpose of my invention and be within its scope and purpose. The fastener illustrated comprises a looped part 15 structurally communicating with a hook part 16, all formed from an elongate, deformable, semi-rigid piece of metal 17 of a wire-like nature. Loop portion 15 may be welded or otherwise solidly formed, or if desired, it may be formed from a metal that may be bent to allow its placement in the same fashion as a hook, without requiring the passing of one end of lace member 10 therethrough for establishment. In fact the member 15 may be a hook similar to that of the hook 16 if desired, though with this arrangement when hooks are then in the non-engaging position it is easy to accidently dis-engage them from a loose lace.

The use of my invention on a shoe is illustrated in FIG. 1. One side lace 10 is established in each adjacent opposed lacing flaps 18 of shoe 12. In this instance a single lace was used, passing alternately through the adjacent eyelets to form alternating loops on the lacing side of the flap between adjacent pairs of eyelets. Laces 10 may be established in this fashion in a particular shoe and left in this position thereafter without any requirement that they be removed or re-established when the shoe is fastened or unfastened. Hook fasteners 14 are established in place upon the elastic side members 10, one hook fastener being distributed for each pair of opposed loops 13 on the fastening side of the fastening flap. The hook fasteners, if the loop portion 15 be rigid, must of necessity be established during placement of the elastic lace member. The hook fasteners may be initially positioned on either side of the fastening flap, or partially on one and partially on the other, though for convenience it is generally preferred to position all of them on the outer fastening flap 18A of the shoe (outer being determined as the shoe would normally be worn).

To use my invention, lace member 10 and hook fasteners 14 are established in place as aforesaid, one hook fastener for each loop 13 of the fastening member on the fastening side of flap 18. The shoe may then be permanently left in this condition as long as is desired. To fasten the closure the shoe is laced upon the foot in normal position and thereafter the elastic laces and hooks manually manipulated to hook the hooked portion 16 of each hook fastener 14 over the laterally adjacent loop of the opposed lace so that paired opposed loops are releaseably fastened to each other. This operation is repeated with each hook-loop combination until each of the adjacent loops is fastened to its paired opposed mate, when the shoe is completely fastened. The shoe is unfastened, for removal, in the reverse fashion.

With many shoes or garments, depending upon size and construction, there may be sufficient elasticity in the fastened closure that the garment may be put on or removed without the complete unhooking of the lacing, or in fact in some instances without any unhooking at all.

It is to be noted from the nature of the invention hereinbefore described, that a laced fastening, particularly in the case of a shoe, completely loosened for either putting on or off when the hooks connecting the laces are dis-engaged, whereas the ordinary laces of commerce must be at least partially removed.

It is further to be noted that my invention may be equally well used upon any lace type closure having co-operating eyelets in adjacent fastening flaps, whether it be upon wearing apparel or upon containers or other articles, the principle being equally applicable to any such use. If the closure to be laced is sufficiently rigid and appropriately pliable, it may not be necessary to have separate eyelet structures, but the device may function equally well upon insertion in holes in the parts to be fastened without any additional support, as especially in the case of sheet plastics.

While the foregoing description is necessarily of a detailed particular character so that a specific embodiment of my invention may be clearly set forth as required, it is to be understood that various rearrangement of parts, multiplications thereof and modifications of detail may be resorted to in connection with the invention without departing from its spirit, scope or essence.

Having thusly described my invention, what I desire to protect by Letters Patent, and,

What I claim is:

1. A fastening device for a lace-type closure having adjacent opposed fastening flaps with plural eyelets spaced inwardly adjacent each opposed edge of the flaps, and comprising, in combination:

paired, elongate elastic laces configured to allow insertion through the eyelets in each fastening flap but be bindable in the said eyelets when stressed away therefrom, each of said laces being laced through adjacent eyelets in each of the fastening flaps to form plural opposed loops on the fastening side of the flaps, and plural fastening members releasably fastening paired opposed fastening loops to each other to cause a releaseable fastening of the laceable closure.

2. The invention of claim 1 wherein the elastic laces are formed of rubber of a rectangular cross-section having one dimension substantially one-fourth greater and the other substantially one-third as great as the major diameter of the eyelets in which the lace is to be positioned.

3. The invention of claim 1 wherein each of the plural fastening members comprises a ring fastenable about one lace structurally communicating with a hook fastenable about the other lace.

* * * * *